US011104125B2

(12) United States Patent
Murate

(10) Patent No.: US 11,104,125 B2
(45) Date of Patent: Aug. 31, 2021

(54) LIQUID DISCHARGE APPARATUS

(71) Applicant: Hirohito Murate, Kanagawa (JP)

(72) Inventor: Hirohito Murate, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/809,696

(22) Filed: Mar. 5, 2020

(65) Prior Publication Data

US 2020/0298556 A1 Sep. 24, 2020

(30) Foreign Application Priority Data

Mar. 19, 2019 (JP) ..... JP2019-051471
Jan. 27, 2020 (JP) ..... JP2020-011046

(51) Int. Cl.
*B41J 2/045* (2006.01)

(52) U.S. Cl.
CPC ..... *B41J 2/0455* (2013.01); *B41J 2/0458* (2013.01); *B41J 2/04581* (2013.01); *B41J 2/04588* (2013.01)

(58) Field of Classification Search
CPC ... B41J 2/0458; B41J 2/04548; B41J 2/04581
See application file for complete search history.

(56) References Cited

U.S. PATENT DOCUMENTS

2012/0194155 A1* 8/2012 Sato ..... B41J 29/393 323/282
2017/0165962 A1 6/2017 Mizutani et al.
2017/0170584 A1* 6/2017 Yang ..... G06K 13/00
2018/0345696 A1* 12/2018 Kodaira ..... B41J 2/04548
2018/0370288 A1* 12/2018 Araujo Da Silva ..... B60C 11/0041

FOREIGN PATENT DOCUMENTS

JP 2010-076329 4/2010
JP 2010-120212 6/2010
JP 2014-218019 11/2014

* cited by examiner

*Primary Examiner* — Lam S Nguyen
(74) *Attorney, Agent, or Firm* — Harness, Dickey & Pierce, P.L.C.

(57) ABSTRACT

A liquid discharge apparatus includes a recording head, a drive waveform generating unit, a transmission path, a switching unit, and a switching control unit. The recording head is configured to discharge liquid. The drive waveform generating unit is configured to generate a head drive waveform signal supplied to the recording head. The transmission path includes a plurality of transmission lines forming pairs and is configured to transmit the head drive waveform signal generated by the drive waveform generating unit to the recording head. the switching unit is arranged between the drive waveform generating unit and the transmission path, and is configured to change directions of electric currents in the transmission lines. The switching control unit is configured to control the switching unit in accordance with a change in a load capacity of the recording head.

7 Claims, 10 Drawing Sheets

LIQUID DISCHARGE APPARATUS

CROSS-REFERENCE TO RELATED APPLICATIONS

The present application claims priority under 35 U.S.C. § 119 to Japanese Patent Application No. 2019-051471, filed on Mar. 19, 2019, and Japanese Patent Application No. 2020-011046, filed on Jan. 27, 2020. The contents of which are incorporated herein by reference in their entirety.

BACKGROUND OF THE INVENTION

1. Field of the Invention

The present invention relates to a liquid discharge apparatus.

2. Description of the Related Art

Conventionally, as one example of an inkjet printer, a liquid discharge apparatus that includes a liquid discharge head or a liquid discharge unit and discharges liquid by driving the liquid discharge head is known. The liquid discharge apparatus includes not only an apparatus that is able to discharge liquid to a target to which liquid can adhere, but also an apparatus that discharges liquid into air or liquid.

A head drive waveform signal that is applied to the liquid discharge head, such as an inkjet head, oscillates due to variation of a capacitive load component of the liquid discharge head, in combination with an inductance component of a transmission line. Therefore, it is demanded to prevent the oscillation and improve a discharge characteristic of the liquid, such as ink.

To improve the discharge characteristic of the ink or the like, a technology for preventing the oscillation of the head drive waveform signal with respect to variation of a load capacity component of the head by switching between two kinds of resisters in front of the transmission path through which the head drive waveform signal is transmitted has been known (see, for example, Japanese Unexamined Patent Application Publication No. 2014-218019, or the like).

However, if the transmission path for transmitting the head drive waveform signal to the liquid discharge head is long, impedance of the transmission path itself is large, and therefore, a resistance value can hardly be changed only by changing the resistance value in front of the transmission path. Therefore, it become difficult to adjust the impedance of the transmission path, and it is difficult to fully prevent the oscillation of the head drive waveform signal.

SUMMARY OF THE INVENTION

According to an aspect of the present invention, a liquid discharge apparatus includes a recording head, a drive waveform generating unit, a transmission path, a switching unit, and a switching control unit. The recording head is configured to discharge liquid. The drive waveform generating unit is configured to generate a head drive waveform signal supplied to the recording head. The transmission path includes a plurality of transmission lines forming pairs and is configured to transmit the head drive waveform signal generated by the drive waveform generating unit to the recording head. the switching unit is arranged between the drive waveform generating unit and the transmission path, and is configured to change directions of electric currents in the transmission lines. The switching control unit is configured to control the switching unit in accordance with a change in a load capacity of the recording head.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
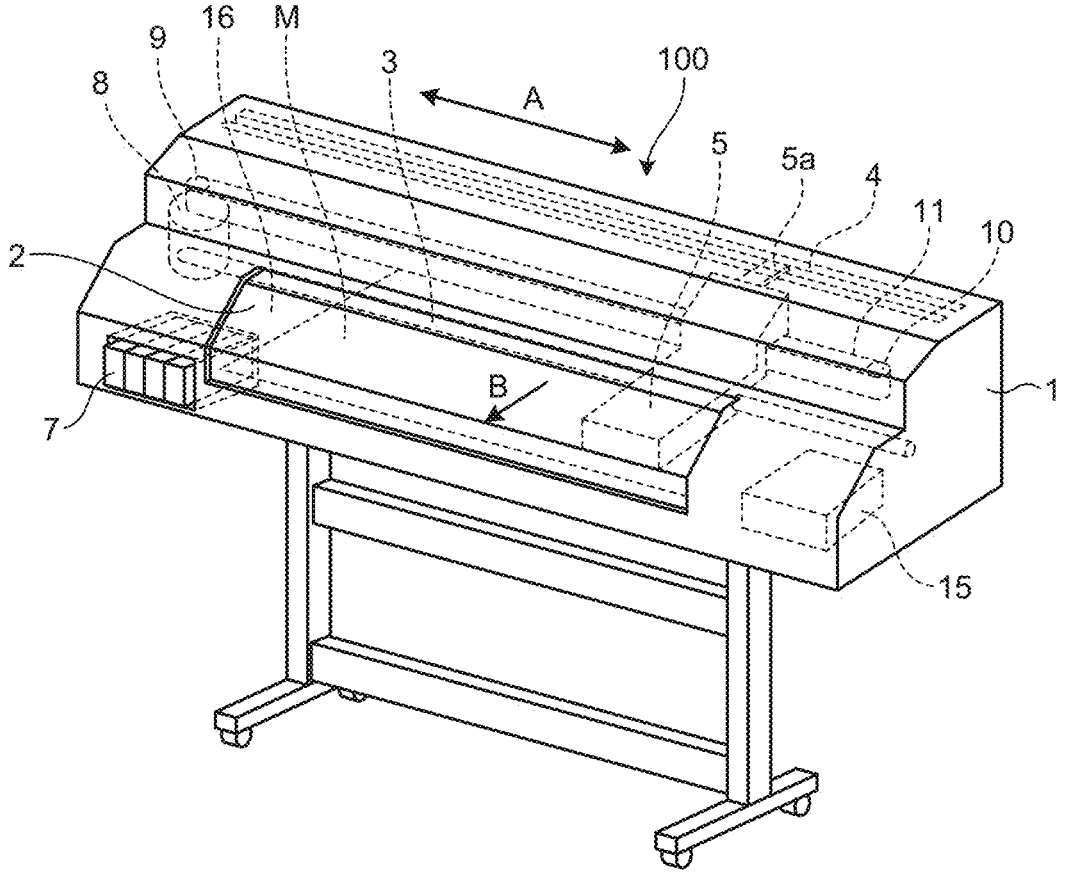
FIG. 1 is a transparent perspective view of an inside of a liquid discharge apparatus.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An embodiment has an object to improve a discharge characteristic of liquid in a liquid discharge apparatus.

Exemplary embodiments of a liquid discharge apparatus will be described below with reference to the accompanying drawings.

Functional Configuration of Liquid Discharge Apparatus

First, a functional configuration of a liquid discharge apparatus 100 according to an embodiment of the present invention will be described with reference to FIG. 1 to FIG.

Figure 2:
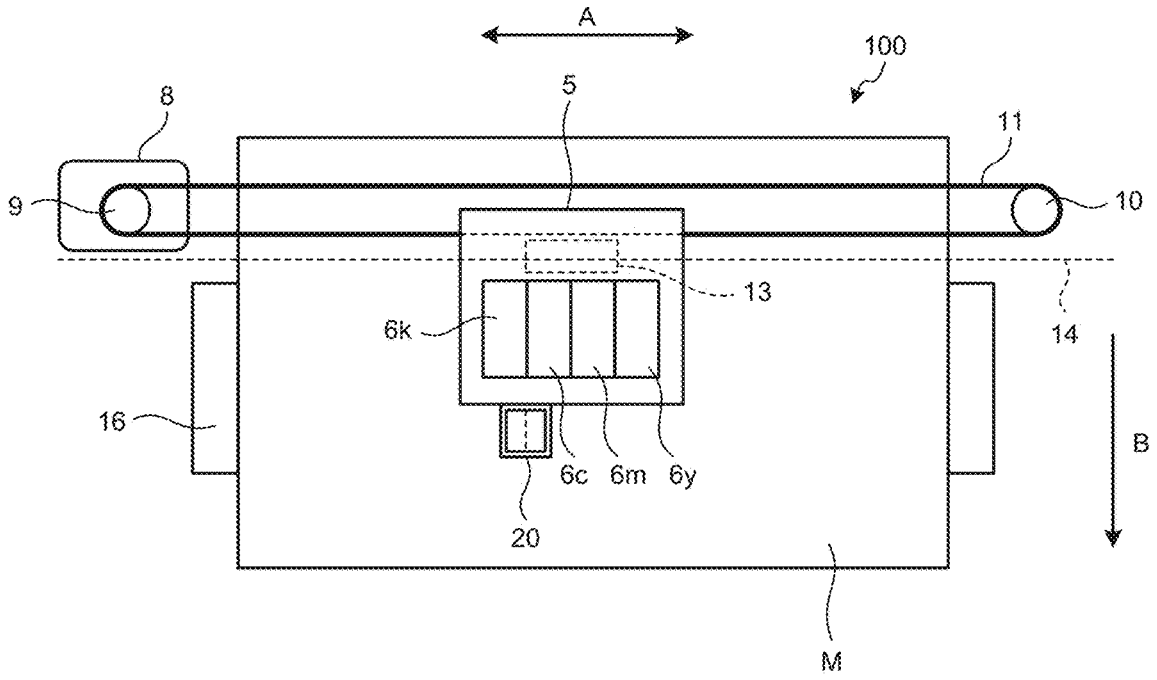
FIG. 2 is a top view illustrating a functional configuration of the inside of the liquid discharge apparatus.
Figure 3:
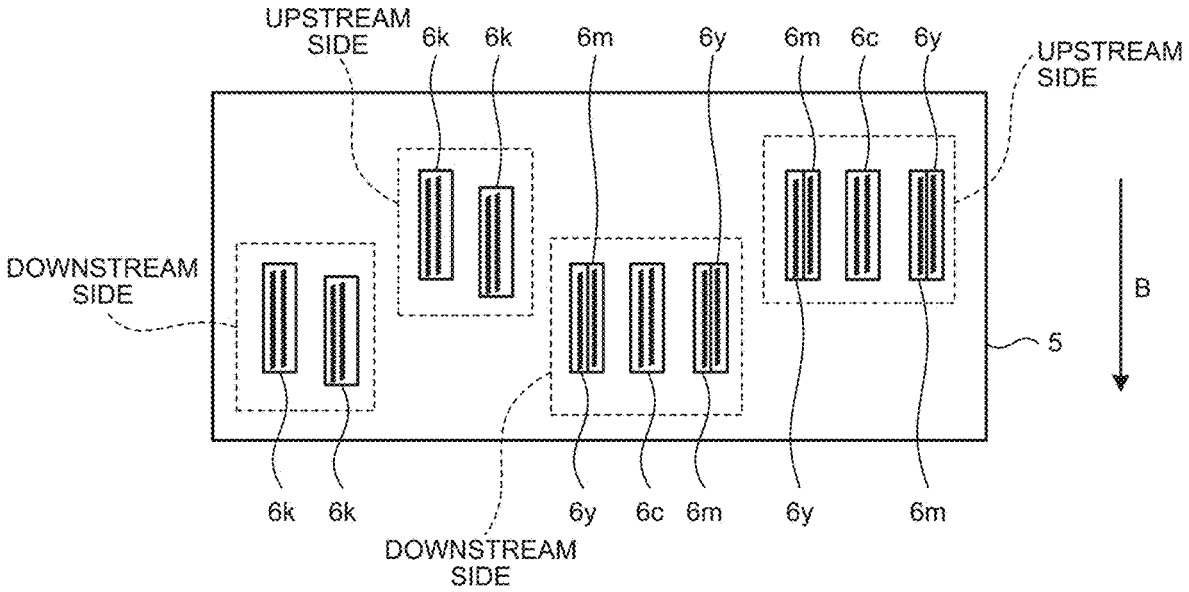
FIG. 3 is a diagram for explaining an arrangement example of a recording head mounted on a carriage.
Figure 4:
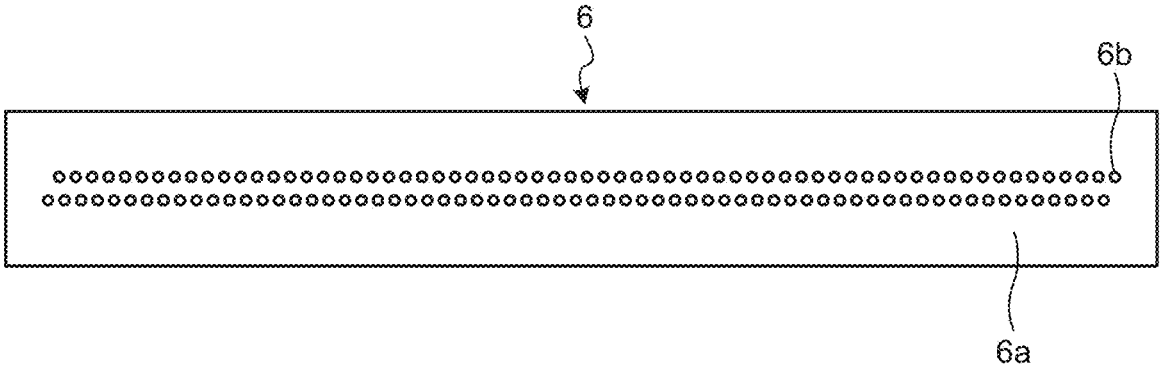
FIG. 4 is an enlarged view of a bottom surface of the recording head.

4. FIG. 1 is a transparent perspective view of an inside of the liquid discharge apparatus 100. FIG. 2 is a top view illustrating a functional configuration of the inside of the liquid discharge apparatus 100. FIG. 3 is a diagram for explaining an arrangement example of a recording head 6 mounted on a carriage 5. FIG. 4 is an enlarged view of a bottom surface of the recording head 6.

As illustrated in FIG. 1, the liquid discharge apparatus 100 according to the embodiment includes the carriage 5 that reciprocates in a main-scanning direction (in a direction of arrow A in the figure). The carriage 5 is supported by a main guide rod 3 that extends in the main-scanning direction. Further, a connection piece 5*a* is arranged in the carriage 5. The connection piece 5*a* is engaged with a sub guide member 4 that is arranged parallel to the main guide rod 3, and stabilizes posture of the carriage 5.

As illustrated in FIG. 2, a recording head 6*y* for discharging yellow ink, a recording head 6*m* for discharging magenta ink, a recording head 6*c* for discharging cyan ink, and a recording head 6*k* for discharging black ink (hereinafter, the recording heads 6*y*, 6*m*, 6*c*, and 6*k* may be collectively referred to as the "recording head 6") are mounted on the carriage 5. The recording head 6 is mounted on the carriage 5 such that a discharge surface (nozzle surface) faces downward (toward a medium M, such as a recording sheet).

Referring back to FIG. 1, a cartridge 7 that is an ink supplier for supplying ink to the recording head 6 is not mounted on the carriage 5, but arranged at a predetermined position inside the liquid discharge apparatus 100. The cartridge 7 and the recording head 6 are connected to each other by a pipe, and ink is supplied from the cartridge 7 to the recording head 6 via the pipe.

The carriage 5 is connected to a timing belt 11 that is stretched between a drive pulley 9 and a driven pulley 10. The drive pulley 9 rotates with drive of a main-scanning motor 8. The driven pulley 10 has a function to adjust a distance to the drive pulley 9, and has a role to apply predetermined tension to the timing belt 11. The carriage 5 reciprocates in the main-scanning direction when the timing belt 11 performs conveying operation with the drive of the main-scanning motor 8. Movement of the carriage 5 in the main-scanning direction is controlled based on an encoder value that is obtained by an encoder sensor 13 arranged on the carriage 5 by detecting a mark on an encoder sheet 14 as illustrated in FIG. 2, for example.

In FIG. 1, the liquid discharge apparatus 100 of the embodiment includes a maintenance mechanism 15 that maintains reliability of the recording head 6. The maintenance mechanism 15 performs cleaning and capping of the discharge surface of the recording head 6, discharge of unnecessary ink from the recording head 6, and the like.

A platen 16 is arranged at position facing the discharge surface of the recording head 6. The platen 16 supports the medium M when ink is discharged from the recording head 6 onto the medium M. The liquid discharge apparatus 100 of the embodiment is a wide apparatus in which a moving distance of the carriage 5 in the main-scanning direction is long. Therefore, the platen 16 is constructed by connecting a plurality of plate members in the main-scanning direction (a moving direction of the carriage 5). The medium M is nipped by a conveying roller that is driven by a sub-scanning motor and intermittently conveyed in the sub-scanning direction (in a direction of arrow B in the figure) on the platen 16.

The recording head 6 includes a plurality of nozzle arrays, and forms an image on the medium M by discharging ink from the nozzle arrays onto the medium M that is conveyed on the platen 16. In the present embodiment, as illustrated in FIG. 3, to ensure a large width of an image that can be formed on the medium M by single scanning of the carriage 5, the upstream recording head 6 and the downstream recording head 6 are mounted on the carriage 5. Further, the number of the recording heads 6*k* for discharging black ink is twice as the number of each of the recording heads 6*y*, 6*m*, and 6*c* for the respective colors on the carriage 5 in order to increase a printing speed for black. Further, each of the recording heads 6*y* and 6*m* is arranged in a manner of being separated into right and left sides. This is done to maintain consistency of order of color superimposition in reciprocation operation of the carriage 5 and prevent color inconsistency between a forward path and a backward path. Meanwhile, the arrangement of the recording head 6 illustrated in FIG. 3 is one example, and arrangement is not limited to the example illustrated in FIG. 3.

Each of the components included in the liquid discharge apparatus 100 of the embodiment is arranged inside an external body 1. A cover member 2 is arranged in the external body 1 in an openable/closeable manner. When maintenance of the liquid discharge apparatus 100 is performed or a jam occurs, it is possible to perform operation on each of the components arranged inside the external body 1 by opening the cover member 2.

The liquid discharge apparatus 100 of the embodiment intermittently conveys the medium M on the platen 16 in the sub-scanning direction, and moves the carriage 5 in the main-scanning direction and discharges ink from the nozzle arrays of the recording head 6 mounted on the carriage 5 onto the medium M on the platen 16 while conveyance of the medium M in the sub-scanning direction is stopped, to thereby form an image on the medium M.

The liquid discharge apparatus 100 of the embodiment includes a two-dimensional image sensor 20 that has a function to capture an image of a color measurement pattern formed on the medium M and calculate a color measurement value. As illustrated in FIG. 2, the two-dimensional image sensor 20 is supported by the carriage 5 on which the recording head 6 is mounted, and moves in an integrated manner. Further, the two-dimensional image sensor 20 moves on the medium M on which the color measurement pattern is formed, in accordance with conveyance of the medium M and movement of the carriage 5, and, when located at a position facing the color measurement pattern, the two-dimensional image sensor 20 captures an image of the color measurement pattern. Then, the two-dimensional image sensor 20 calculates the color measurement value of the color measurement pattern on the basis of RGB values of the color measurement pattern obtained by capturing of the image.

In FIG. 4, a large number of printing nozzles 6*b* are arranged in a zig-zag manner on a nozzle surface (bottom surface) 6*a* of the recording head 6. In the embodiment, the printing nozzles 6*b* are arranged in two arrays in a zig-zag manner such that each of the arrays includes the 64 printing nozzles 6*b*. By arranging the large number of printing nozzles 6*b* in a zig-zag manner as described above, it is possible to deal with high resolution.

Figure 5:
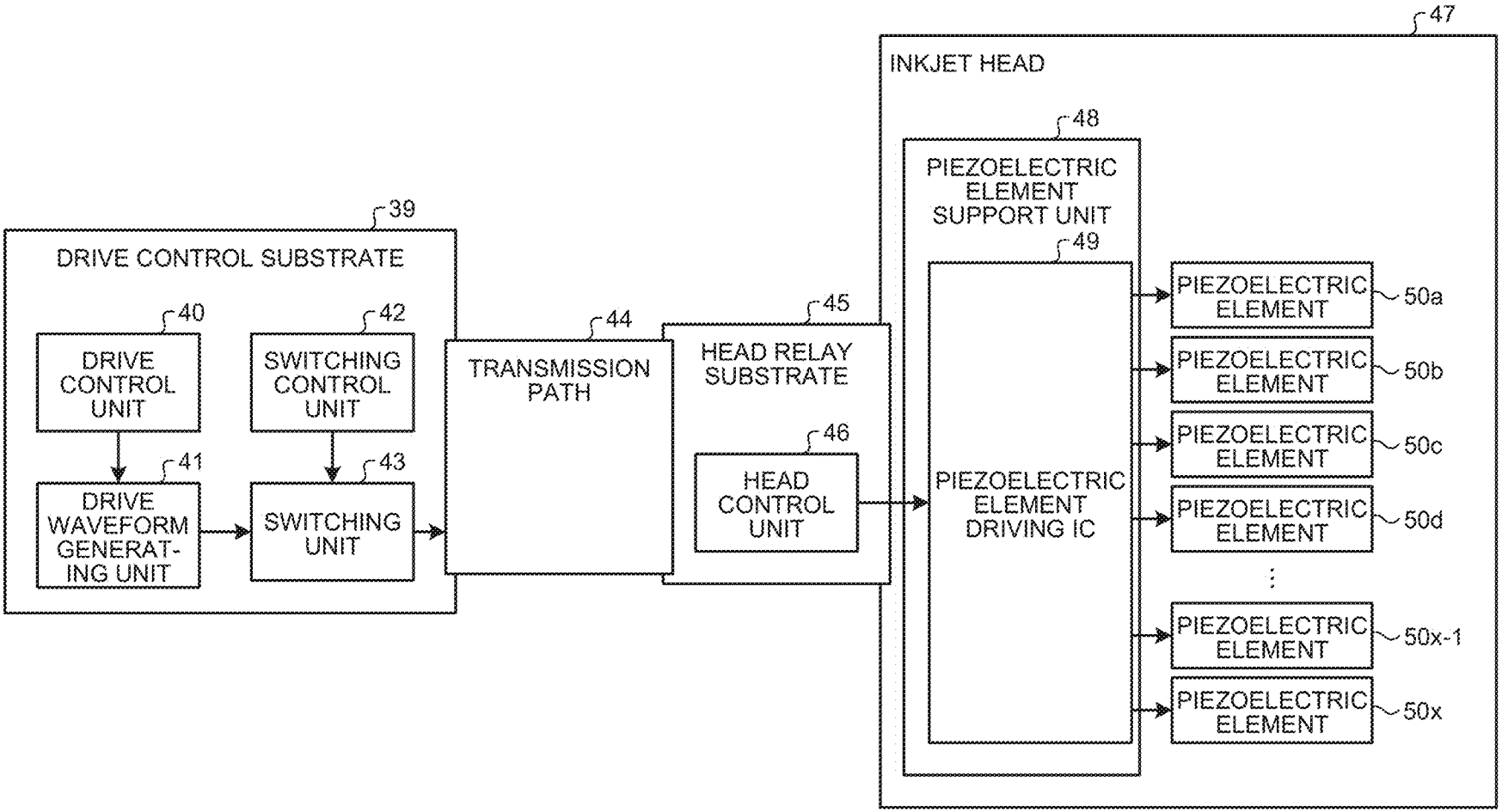
FIG. 5 is a block diagram illustrating a configuration example of the liquid discharge apparatus.

FIG. 5 is a block diagram illustrating a configuration example of the liquid discharge apparatus 100. In FIG. 5, a drive control substrate 39, a transmission path 44, a head relay substrate 45, and an inkjet head 47 are arranged in the liquid discharge apparatus 100. One end of the transmission path 44 is connected to the drive control substrate 39, and the other end of the transmission path 44 is connected to the inkjet head 47 via the head relay substrate 45. The transmission path 44 includes a plurality of transmission lines forming pairs, and is made of, for example, a flexible flat cable (FFC). The transmission path 44 includes, in a plurality of transmission lines, portions in which current flow directions are different. The inkjet head 47 corresponds to the recording head 6 as described above.

The drive control substrate 39 includes a drive control unit 40, a drive waveform generating unit 41, a switching control unit 42, and a switching unit 43. The drive control unit 40 generates a timing control signal and drive waveform data for driving piezoelectric elements 50 of the inkjet head 47, on the basis of image data to be printed. The drive waveform generating unit 41 performs digital-to-analog (DA) conversion on the drive waveform data with a digital value generated by the drive control unit 40, and amplifies a voltage and an electric current. The switching control unit 42 controls the switching unit 43 in accordance with the number of the piezoelectric elements 50 that are driven simultaneously (the number of nozzles that discharge liquid simultaneously). Variation of the number of nozzles that discharge liquid simultaneously and variation of load capacity are calculated based on image data input to the liquid discharge apparatus 100. The switching unit 43 switches between paths of the head drive waveform signal in the transmission path 44.

The head drive waveform signal for which the voltage and the electric current are amplified by the drive waveform generating unit 41 is output to the path that is switched by the switching unit 43 in the transmission path 44. Meanwhile, a digital signal, such as the timing control signal, generated by the drive control unit 40 of the drive control substrate 39 is transmitted to the head relay substrate 45 by serial communication, deserialized by a head control unit 46 on the head relay substrate 45, and transmitted to the inkjet head 47.

The signal transmitted to the inkjet head 47 is input to a piezoelectric element driving integrated circuit (IC) 49 on a piezoelectric element support unit 48 in the inkjet head 47. The head drive waveform signal generated by the drive waveform generating unit 41 of the drive control substrate 39 is input to the piezoelectric elements 50 by turning on and off the piezoelectric element driving IC 49 in accordance with the timing control signal.

Figure 6:
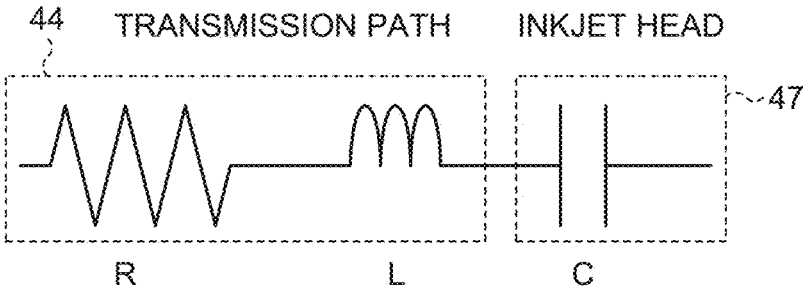
FIG. 6 is a diagram illustrating an example of an equivalent circuit of a transmission path and an inkjet head.

FIG. 6 is a diagram illustrating an example of an equivalent circuit of the transmission path 44 and the inkjet head 47. In FIG. 6, the transmission path 44 is represented by a series circuit of a resistor component R and an inductance component L, and the inkjet head 47 is represented by a capacity (capacitance) component C. Total impedance viewed from the drive control substrate 39 side is equal to impedance of a series circuit of the resistor component R, the inductance component L, and the capacity component C. An absolute value of the total impedance is represented by Expression (1) below.

$$\dot{Z}| = \sqrt{R^2 + \left(\omega L - \frac{1}{\omega C}\right)^2} \quad [\Omega] \tag{1}$$

The resistor component R increases in proportion to a length of the transmission path 44, and the length of the transmission path 44 has a fixed value because the length is fixed in the liquid discharge apparatus 100. As for the inductance component L, as will be described in detail later, if the transmission path includes a plurality of transmission lines forming pairs, portions in which current flow directions are different are present; therefore, mutual inductance occurs depending on the direction of an electric current that flows in each of the transmission lines, so that the inductance components L are cancelled out and a value of the inductance component L of the entire transmission path 44 can be adjusted. The capacity component C increases with an increase in the number of discharge nozzles (the number of nozzles that discharge liquid simultaneously) in the inkjet head 47; therefore, the capacity component C varies.

Therefore, if the number of discharge nozzles is small (if the capacity component C is small), it is possible to reduce a value of $\omega L - 1/\omega C$ by increasing the inductance component L. If the number of discharge nozzles is large (if the capacity component C is large), it is possible to reduce the value of $\omega L - 1/\omega C$ by reducing the inductance component L. In this manner, by changing the inductance component L in accordance with an increase and a decrease of the capacity component C, it is possible to maintain the impedance constant, so that it is possible to prevent oscillation of the head drive waveform signal due to variation of the load capacity of the inkjet head 47, and it is possible to supply the head drive waveform signal having a stable behavior to the inkjet head 47.

Figure 7A:
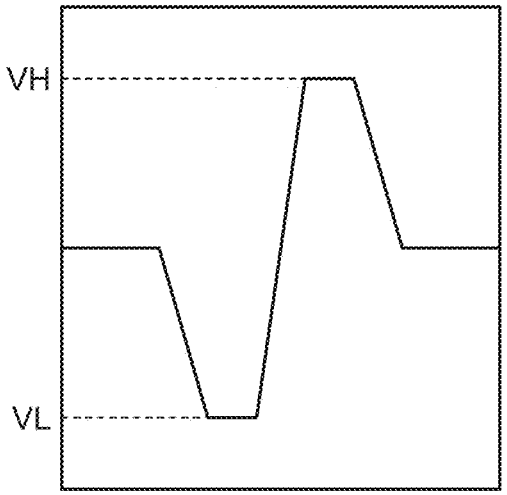
FIG. 7A is a diagram illustrating a first example of a head drive waveform signal that is applied to the inkjet head.
Figure 7B:
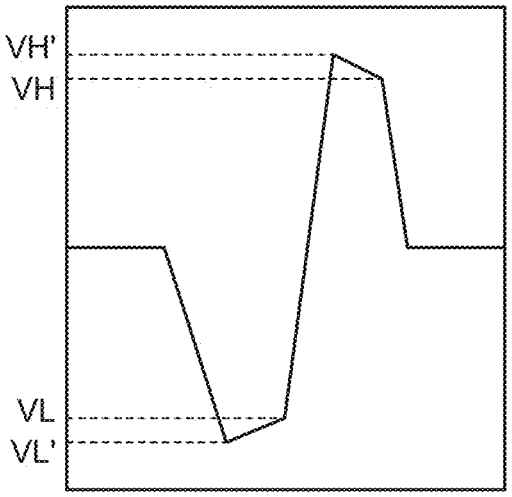
FIG. 7B is a diagram illustrating a second example of the head drive waveform signal that is applied to the inkjet head.
Figure 7C:
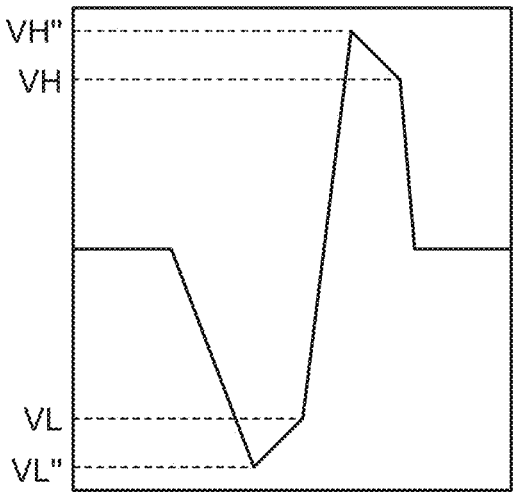
FIG. 7C is a diagram illustrating a third example of the head drive waveform signal that is applied to the inkjet head.

FIG. 7A to FIG. 7C are diagrams illustrating examples of the head drive waveform signal that is applied to the inkjet head 47. The head drive waveform signal is generated by the drive waveform generating unit 41 of the drive control substrate 39 as described above.

FIG. 7A illustrates an example of the head drive waveform signal when the inkjet head 47 has a low load (when the number of discharge nozzles is small). The capacity load component is small, and accordingly, a current value flown into the inkjet head 47 is small and impedance including the inkjet head 47 and the transmission path 44 is small; therefore, the head drive waveform signal is less likely to be influenced by oscillation. Consequently, a waveform is stable at a low level voltage VL and a high level voltage VH. An ink discharge speed at this time is denoted by $V_{j0}$, for example.

FIG. 7B illustrates an example of the head drive waveform signal when the inkjet head 47 has a medium load (when the number of discharge nozzles is medium). The capacity load component is larger than that of FIG. 7A, and accordingly, the current value flown into the inkjet head 47 increases and the impedance including the inkjet head 47 and the transmission path 44 increases; therefore, a waveform amplitude of the head drive waveform signal increases due to oscillation. Consequently, the waveform reaches a voltage VL' that is lower than the low level voltage VL, and the waveform reaches a voltage VH' that is higher than the high level voltage VH. If an ink discharge speed at this time is denoted by $V_{j1}$, because of the increase in the waveform amplitude, a relationship with the ink discharge speed in the case in FIG. 7A is represented as follows.

$$V_{j1} > V_{j0}$$

FIG. 7C illustrates an example of the head drive waveform signal when the inkjet head 47 has a high load (when the number of discharge nozzles is large). The capacity load component is larger than that of FIG. 7B, and accordingly, the current value flown into the inkjet head 47 increases and the impedance including the inkjet head 47 and the transmission path 44 increases; therefore, the waveform amplitude of the head drive waveform signal further increases due to oscillation. Consequently, the waveform reaches a voltage VL" that is lower than the low level voltage VL, and the waveform reaches a voltage VH" that is higher than the high level voltage VH. If an ink discharge speed at this time is denoted by $V_{j2}$, because of the increase in the waveform amplitude, a relationship with the ink discharge speeds in the cases in FIG. 7A and FIG. 7B is represented as follows.

$$V_{j2}>V_{j1}>V_{j0}$$

In FIG. 7A to FIG. 7C, it is explained that the waveform amplitude increases due to the oscillation; however, in reality, in some cases, the waveform may be rounded (a rising slew rate of the waveform is reduced) with an increase in the number of discharge nozzles), and the amplitude may be reduced. For simplicity of explanation, the case is described in which the waveform oscillates and the waveform amplitude increases; however, in the case in which the waveform is rounded, a situation in which the waveform deviates from a normal state similarly occurs.

Figure 8:
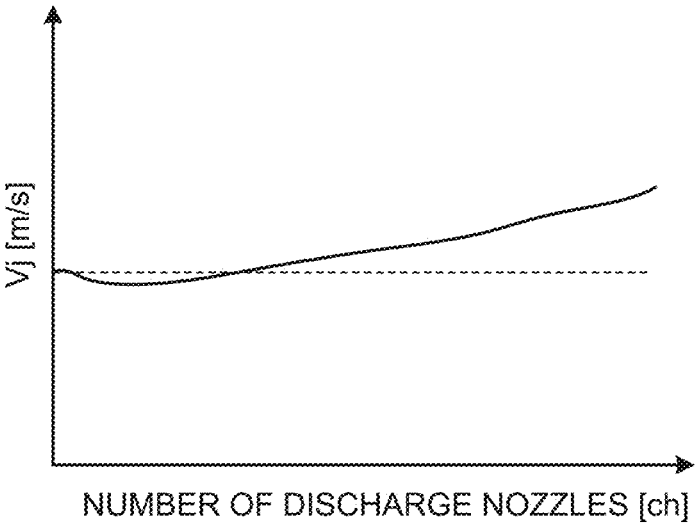
FIG. 8 is a diagram illustrating an example of a relationship between the number of discharge nozzles of the inkjet head and an a discharge characteristic (discharge speed) of ink.

FIG. 8 is a diagram illustrating an example of a relationship between the number of discharge nozzles of the inkjet head 47 and a discharge characteristic (discharge speed) of ink. In FIG. 8, a dashed line indicates an ideal relationship between the number of discharge nozzles and a discharge speed $V_j$ of ink, and indicates a case in which the discharge speed $V_j$ is constant with respect to the number of discharge nozzles. Further, a solid line indicates a relationship between the actual number of discharge nozzles and the discharge speed $V_j$ of ink. As described above with reference to FIG. 7A to FIG. 7C, the waveform amplitude increases due to oscillation with an increase in the number of discharge nozzles, so that the discharge speed $V_j$ of ink increases and a behavior as indicated by the solid line occurs. If the discharge speed $V_j$ of ink varies depending on the number of discharge nozzles, image unevenness occurs and image quality is reduced.

Figure 9:
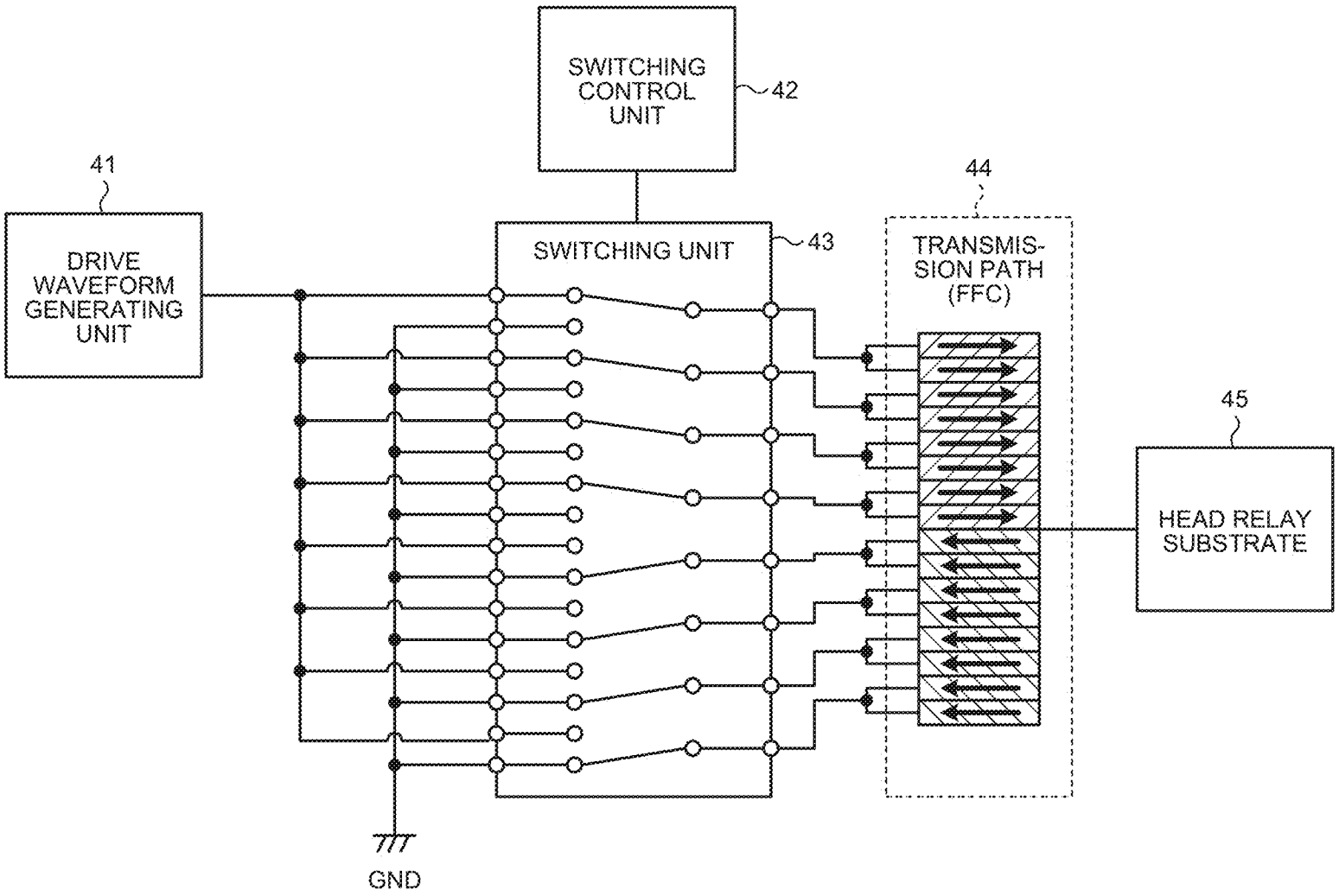
FIG. 9 is a diagram illustrating a first example of adjustment of impedance of the transmission path.
Figure 10:
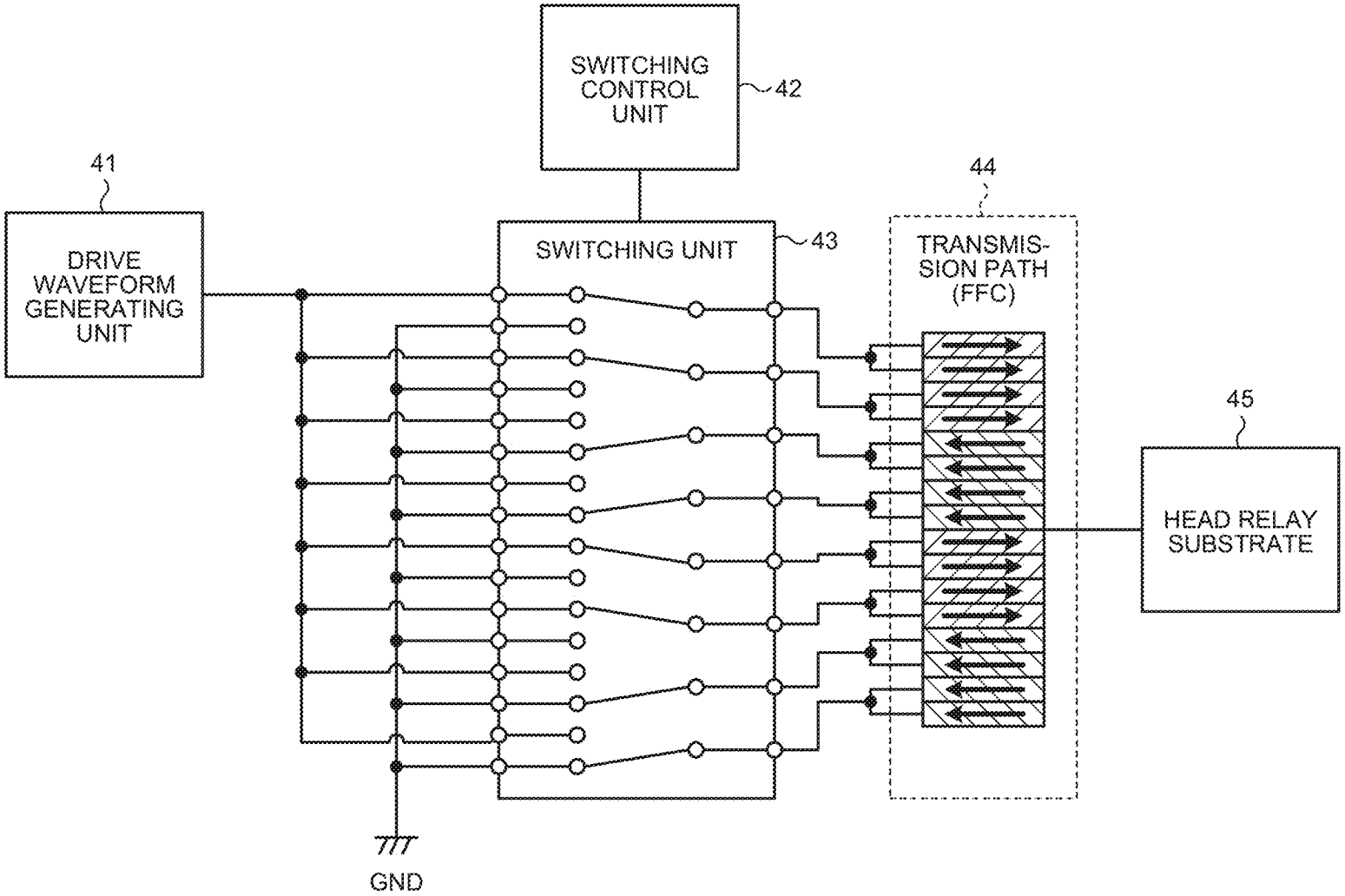
FIG. 10 is a diagram illustrating a second example of adjustment of impedance of the transmission path.
Figure 11:
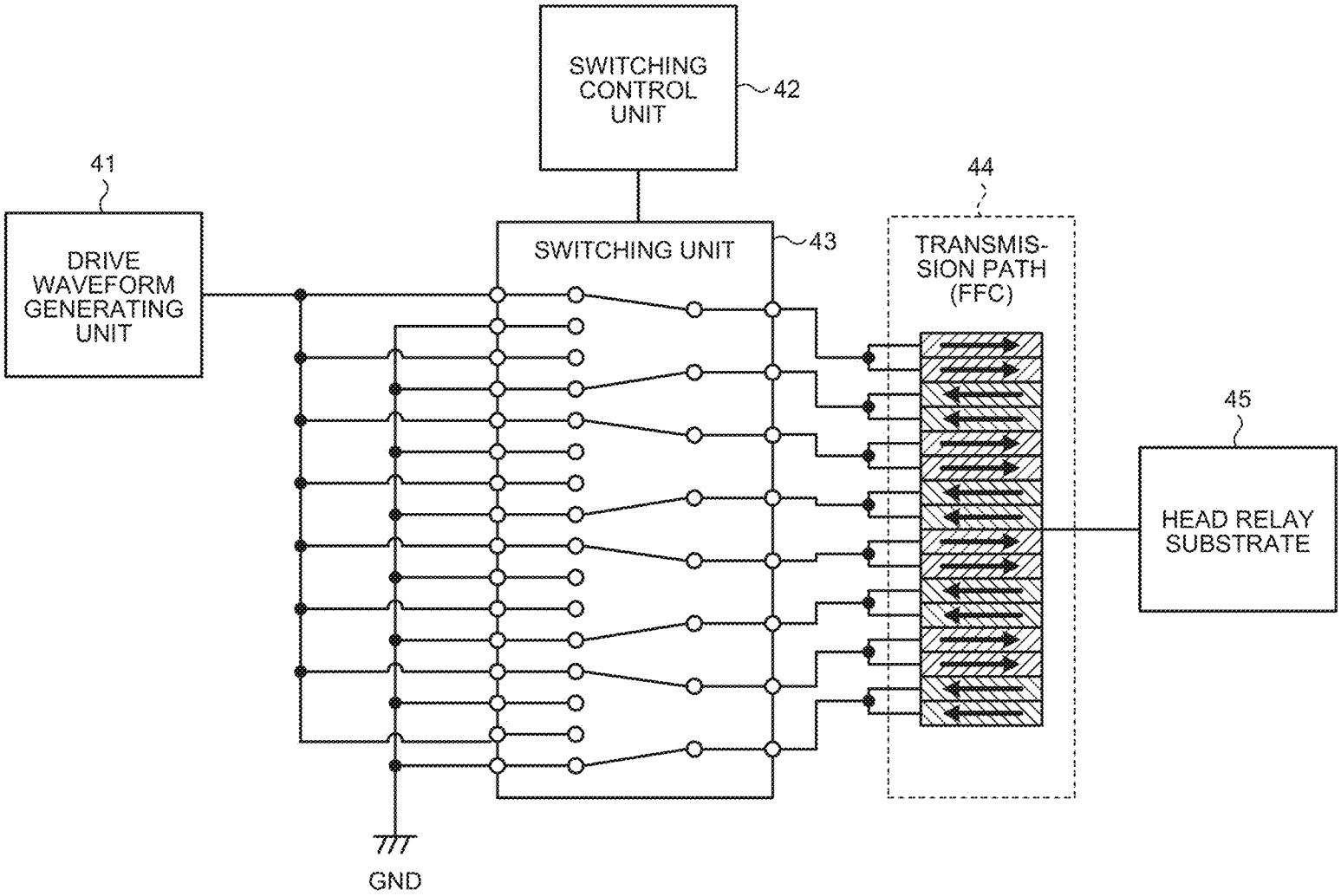
FIG. 11 is a diagram illustrating a third example of adjustment of impedance of the transmission path.

FIG. 9 to FIG. 11 are diagrams illustrating examples of adjustment of the impedance of the transmission path 44, where it is assumed that the transmission path 44 includes 16 transmission lines. Meanwhile, the number of transmission lines is not limited thereto.

As described above, even if the transmission path 44 is long, it is possible to adjust the inductance component by changing the current flow direction. When electric currents flow in opposite directions, mutual induction (mutual inductance) occurs, so that the inductance components are cancelled out.

In FIG. 9, the head drive waveform signal generated by the drive waveform generating unit 41 is connected to the transmission path 44 by the switching unit 43 controlled by the switching control unit 42 and transmitted to the head relay substrate 45. An arrow in each of the transmission lines included in the transmission path 44 indicates a direction of an electric current, where the transmission lines oriented rightward in the figure indicate paths through which the electric currents of the head drive waveform signal flow into the inkjet head 47, and the transmission lines oriented leftward in the figure indicate paths through which the electric currents of the head drive waveform signal is drawn from the inkjet head 47. To adjust the inductance component of the transmission path 44 by using the mutual inductance, the switching unit 43 changes the directions in which the electric currents flow.

In FIG. 9, due to a contact state of the switching unit 43, the first to the eights transmission lines from the top in the transmission path 44 serve as the paths through which the electric currents flow into the inkjet head 47, and the ninth to the sixteenth transmission lines serve as the paths through which the electric currents are drawn from the inkjet head 47. The inductance component of the transmission path 44 in this state is denoted by L1.

In FIG. 10, due to the contact state of the switching unit 43, the first to the fourth and the ninth to the twelfth transmission lines from the top in the transmission path 44 serve as the paths through which the electric currents flow into the inkjet head 47, and the fifth to the eighth and the thirteenth to the sixteenth transmission lines serve as the paths through which the electric currents are drawn from the inkjet head 47. By causing the switching unit 43 controlled by the switching control unit 42 to change the direction in which the electric current flows in each of the transmission lines in the transmission path 44, the inductance components are cancelled out due to the action of the mutual inductance, so that the inductance component is reduced. If the inductance component of the transmission path 44 in this state is denoted by L2, a relationship with the inductance component in FIG. 9 is represented as follows.

$$L1>L2$$

The reason why this relationship is established is that portions where the mutual inductance occur (pair portions in which the directions of the electric currents are opposite to each other) increase as compared to the case in FIG. 9.

In FIG. 11, due to the contact state of the switching unit 43, the first, the second, the fifth, the sixth, the ninth, the tenth, the thirteenth, and the fourteenth transmission lines from the top in the transmission path 44 serve as the paths through which the electric currents flow into the inkjet head 47, and the third, the fourth, the seventh, the eighth, the eleventh, the twelfth, the fifteenth, and the sixteenth transmission lines serve as the paths through which the electric currents are drawn from the inkjet head 47. By causing the switching unit 43 controlled by the switching control unit 42 to change the direction in which the electric current flows in each of the transmission lines in the transmission path 44, the inductance components are cancelled out due to the action of the mutual inductance, so that the inductance component is reduced. If the inductance component of the transmission path 44 in this state is denoted by L3, a relationship with the inductance components in FIG. 9 and FIG. 10 is represented as follows.

$$L1>L2>L3$$

The reason why this relationship is established is that the portions where the mutual inductance occurs increase as compared to the case in FIG. 10.

In this manner, the switching control unit 42 and the switching unit 43 change the direction of the electric current of the head drive waveform signal that flows in the transmission path 44 by changing the load capacity (capacity component) of the inkjet head 47; therefore, even if the load capacity varies, it is possible to prevent oscillation of the head drive waveform signal, and it is possible to supply the head drive waveform signal having a stable behavior to the inkjet head 47.

The inkjet printer has been described above as one example of the liquid discharge apparatus; however, embodiments are not limited thereto.

The liquid discharge apparatus may include means for feeding, conveying, and ejecting a target to which liquid can adhere, and may further include a pre-processing apparatus, a post-processing apparatus, and the like.

For example, the liquid discharge apparatus may be an image forming apparatus that is an apparatus for forming an image by discharging ink onto a sheet, and a stereoscopic modeling apparatus (three-dimensional modeling apparatus)

that discharges modeling liquid onto powder layers, in which powders are laminated, in order to model a stereoscopic modeled object (three-dimensional modeled object).

Further, the liquid discharge apparatus is not limited to an apparatus by which a significant image, such as a character or a graphic, is visualized by discharged ink. For example, an apparatus that forms a pattern or the like that does not have a meaning in itself and an apparatus that models a three-dimensional image may be adopted.

The "target to which liquid can adhere" as described above is an object to which liquid can adhere at least temporarily, and represents an object to which liquid adheres and sticks, an object to which liquid adheres and penetrates, and the like. Specifically, the target may be a target recording medium, such as a sheet, a recording paper, a recording sheet, a film, or a cloth, an electronic component, such as an electronic substrate or a piezoelectric element, or a medium, such as a powder layer (powdered layer), an organ model, or an examination cell, and includes all of objects to which liquid adheres unless specifically limited.

A material of the "target to which liquid can adhere" may be any material, such as paper, thread, fiber, fabric cloth, leather, metal, plastic, glass, wood, or ceramics, to which liquid can adhere at least temporarily.

Furthermore, the "liquid" is not specifically limited as long as the liquid has a viscosity and surface tension that allow the liquid to be discharged from the head; however, it is preferable that the liquid has a viscosity of 30 mPa/s or below when heated and cooled under normal temperature and normal pressure. More specifically, the liquid may be a solution, a suspension, an emulsion, or the like that contains a solvent such as water or an organic solvent, a colorant such as a dye or a pigment, a function providing material such as a polymerizable compound, a resin, or a surfactant, a biomaterial such as DNA, amino acid, protein, or calcium, or an edible material such as a natural pigment, and, the liquid may be used for uses such as ink for inkjet, a surface treatment liquid, a liquid for forming a constituent element of an electron element or a light-emitting element or for forming an electronic circuit resist pattern, and a material liquid for three-dimensional modeling.

The apparatus includes an apparatus that uses, as an energy generation source for discharging liquid, a piezoelectric actuator (a laminated piezoelectric element and a thin-film piezoelectric element, a thermal actuator using an electric-to-heat conversion element such as a heat generation resistor, or an electrostatic actuator formed of a vibration plate and an opposing electrode.

Furthermore, the liquid discharge apparatus is an apparatus in which the liquid discharge head and the target to which liquid can adhere move relative to each other, but is not limited thereto. Specifically, a serial-type apparatus that moves the liquid discharge head, a linear-type apparatus that does not move the liquid discharge head, and the like may be adopted.

Moreover, the liquid discharge apparatus includes a treatment liquid applying apparatus that discharges treatment liquid onto a a sheet to apply the treatment liquid to a surface of the sheet in order to modify the surface of the sheet, a jet granulation apparatus that ejects composition liquid that is obtained by dispersing raw materials in a solution, and forms fine grains of the raw materials through granulation.

Furthermore, in the present application, image formation, recording, typing, picture printing, printing, and modeling are assumed as synonymous words.

According to an embodiment, it is possible to improve a discharge characteristic of liquid in a liquid discharge apparatus.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a recording head configured to discharge liquid;

a drive waveform generating unit configured to generate a head drive waveform signal supplied to the recording head;

a transmission path including a plurality of transmission lines forming pairs and configured to transmit the head drive waveform signal generated by the drive waveform generating unit to the recording head;

a switching unit arranged between the drive waveform generating unit and the transmission path, and configured to change directions of electric currents in the transmission lines; and a switching control unit configured to control the switching unit in accordance with a change in a load capacity of the recording head.

2. The liquid discharge apparatus according to claim 1, wherein the transmission path comprises flexible flat cables.

3. The liquid discharge apparatus according to claim 1, wherein the switching unit is configured to switch a path of each transmission line of the plurality of transmission lines in the transmission path between a path in which one end of the transmission line at the switching unit is connected to an output of the drive waveform generating unit and a path in which the one end is grounded.

4. The liquid discharge apparatus according to claim 1, wherein the switching control unit is configured to control the switching unit in accordance with number of nozzles to simultaneously discharge liquid in the recording head.

5. The liquid discharge apparatus according to claim 4, wherein the switching control unit is configured to determine the number of nozzles to simultaneously discharge liquid in the recording head, based on discharge data for instructing the recording head to discharge liquid.

6. The liquid discharge apparatus according to claim 4, wherein the switching control unit is configured to switch the switching unit such that portions where mutual inductance occurs are reduced, when the number of nozzles to simultaneously discharge liquid in the recording head is equal to or smaller than a first threshold.

7. The liquid discharge apparatus according to claim 4, wherein the switching control unit is configured to switch the switching unit such that portions where mutual inductance occurs are increased, when the number of nozzles to simultaneously discharge liquid in the recording head is equal to or larger than a second threshold.

* * * * *